United States Patent [19]

Pusch et al.

[11] Patent Number: 4,473,826

[45] Date of Patent: Sep. 25, 1984

[54] ARRANGEMENT BROAD-BAND CAMOUFLAGING OF MILITARY TARGETS

[75] Inventors: Günter Pusch, Bannholzweg 12, 6903 Neckargemünd 2, Fed. Rep. of Germany; Alexander Hoffmann, Mauer; Dieter E. Aisslinger, Geisenheim, both of Fed. Rep. of Germany

[73] Assignee: Günter Pusch, Neckargemünd, Fed. Rep. of Germany

[21] Appl. No.: 226,787

[22] Filed: Jan. 21, 1981

Related U.S. Application Data

[63] Continuation of Ser. No. 942,703, Aug. 23, 1978, abandoned.

[30] Foreign Application Priority Data

Nov. 15, 1977 [DE] Fed. Rep. of Germany ..... 2750919

[51] Int. Cl.[3] ..... F41H 3/02

[52] U.S. Cl. ..... 343/18 E; 135/93; 350/1.7

[58] Field of Search ..... 135/88, 93, 94, 115; 165/47; 343/18 B, 18 E; 350/1.1, 1.6, 1.7; 428/919

[56] References Cited

U.S. PATENT DOCUMENTS

| | | | |
|---|---|---|---|
| 1,817,871 | 8/1931 | Brandt | 428/919 |
| 2,983,821 | 5/1961 | Cap | 250/518.1 |
| 4,069,668 | 1/1978 | Oldberg | 60/320 |
| 4,289,677 | 9/1981 | Supcoe et al. | 250/353 |

FOREIGN PATENT DOCUMENTS

| | | |
|---|---|---|
| 2056211 | 5/1972 | Fed. Rep. of Germany . |
| 2252431 | 5/1974 | Fed. Rep. of Germany . |
| 2310088 | 9/1974 | Fed. Rep. of Germany . |
| 2016404 | 1/1977 | Fed. Rep. of Germany . |
| 2731205 | 1/1979 | Fed. Rep. of Germany . |
| 2700202 | 2/1983 | Fed. Rep. of Germany . |
| 1605131 | 12/1981 | United Kingdom . |

OTHER PUBLICATIONS

A. T. Sylvester, II "Camouflage for Battle Survival", National Defense, vol. LXIII, No. 399, Jul.-Aug. 1978, pp. 48, 49, 53.

*Primary Examiner*—Stephen C. Bentley
*Attorney, Agent, or Firm*—Michael N. Meller

[57] ABSTRACT

An arrangement for camouflaging military targets in the spectral range of electromagnetic radiation from ultraviolet light to radar waves by contrast reduction between target and background. Emission and/or remission contrast of the target towards the natural background is reduced by applying camouflaging nets which are provided with a specially cut garnishing made of a compound texture in which each single layer affects part of the total electromagnetic spectrum. The layers are arranged so that the camouflaging effect of a single layer does not destroy the others. The reduction of the temperature contrast between target and background of warm or hot targets is achieved by means of heat-reduction carpets. The reduction of temperature contrast of objects currently producing heat is achieved by additionally blowing off hot gases that are surrounded by laminar flows of cold air in special channels where warming up of the camouflaging set-up itself by the hot gases is avoided. The hot areas of the military objects are covered by heat-reduction carpets at a distance of a few inches, thereby allowing air circulation beneath. By applying the broad-band camouflaging nets above the carpets, shadows are applied to the carpets during sunlight so that additional heating by sunlight is avoided.

17 Claims, 4 Drawing Figures

ARRANGEMENT BROAD-BAND CAMOUFLAGING OF MILITARY TARGETS

This application is a continuation of application Ser. No. 942,703, filed Aug. 23, 1978, now abandoned.

BACKGROUND OF THE INVENTION

The present invention relates to broad-band camouflaging of military targets in the spectral range of electromagnetic radiation from ultraviolet light to radar waves in which a combination of different means and factors optimizes the camouflaging effect for the particular sections.

According to the previous work of the inventor, one or several of the following three measures can be taken for camouflaging military targets in the spectral region of the atmospheric windows where thermal images can be transmitted:

1. Reduction of the emission and remission contrast of the target towards the natural background is achieved by applying camouflaging nets which are provided with garnishing, cut in a known manner. The adaption and/or structurization of emission and remission of the IR radiation in the spectral region of said atmospheric windows is achieved by coating the garnishing with an infrared-reflecting layer and then with a suitable camouflage paint, comprising a pigment having camouflage properties in the visible and near IR range and having an emissivity less than 90% in the spectral ranges 3 to 5 μm and 8 to 14 μm.

2. The temperature contrast of the target towards the natural background that would allow a detection of warm or hot objects in the spectral region at a large distance is to be reduced by means of heat-reduction carpets comprising heat-blocking or heat isolating outer material layers and inner metal foil layers, set out in disclosure document No. P 22 52 431 dated Oct. 26, 1972 and published May 2, 1974.

3. In the case of military targets which currently produce heat, the generated heat is removed in the form of hot gases to reduce the temperature contrast. The hot exhaust gases are surrounded by cold air flowing laminarly in special air channels out of the camouflaging set-up, to avoid that the set-up and the air-conducting channels themselves are warmed up as disclosed in the principles of the patent application No. p 27 31 205.

In light of these previous studies of the inventor, it is now the object of the present invention to provide a broad-band camouflaging arrangement for military targets in the spectral range of electromagnetic radiation from ultraviolet light to radar waves, comprising a camouflaging net which is substantially simple in construction and may be economically fabricated.

Another object of the present invention is to provide an arrangement of the foregoing character which is substantially compact and does not require highly skilled personnel to apply.

A further object of the present invention is to provide an arrangement, as described, which has a substantially long service time before requiring replacement.

SUMMARY OF THE INVENTION

The objects of the present invention are achieved by providing a camouflaging arrangement for the military targets in the spectral range of electromagnetic radiation from ultra violet to radar waves by contrast reduction between target and background, in which emission and/or remission contrast of the targets toward the natural background is reduced by applying camouflaging nets. These are provided with specially cut garnishing made of a compound texture in which each single affects part of the total electromagnetic spectrum.

The arrangement of the layers is carried out so that the camouflaging effect of a single layer does not destroy or interfere with the others. The reduction of the temperature contrast between target and background of warm or hot targets is achieved by means of heat-reduction carpets.

The reduction of temperature contrast of objects currently producing heat is achieved by additionally blowing off hot gases that are surrounded by laminar flows of cold in special channels where warming up of the camouflaging arrangement by the hot gases is avoided.

The hot areas of the military objects are covered by heat reduction carpets at a distance of a few inches, allowing thereby, air circulation in the space. By applying the broad-band camouflaging nets above the carpets in this manner, they are cooled by wind and provide shadow upon the carpets during sunlight so that additional heating by the sunlight is prevented.

The camouflaging net may be provided with a specially cut garnishing carrying metalized layers reflecting incident radar waves.

The sheeting for the manufacture of the heat-reduction carpet and the garnishing of camouflaging nets is made of the same material. This is a metalized material on one or both sides, and is then provided with special camouflaging paint, which are reflective in the range from ultraviolet to the far infrared region. The metalization may be achieved by metallic paint in which the binder is to a large extent transparent to the infrared radiation. At the same time the metalization may also be carried out chemically, by a precipitate of metal out of a metal-salt solution or dispersion.

The sheeting may also be subjected to a glow-discharge, and then be metalized by a vacuum vapor deposition process.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTIONS OF THE DRAWINGS

DESCRIPTION OF THE PREFERRED EMBODIMENTS

Figure 1:
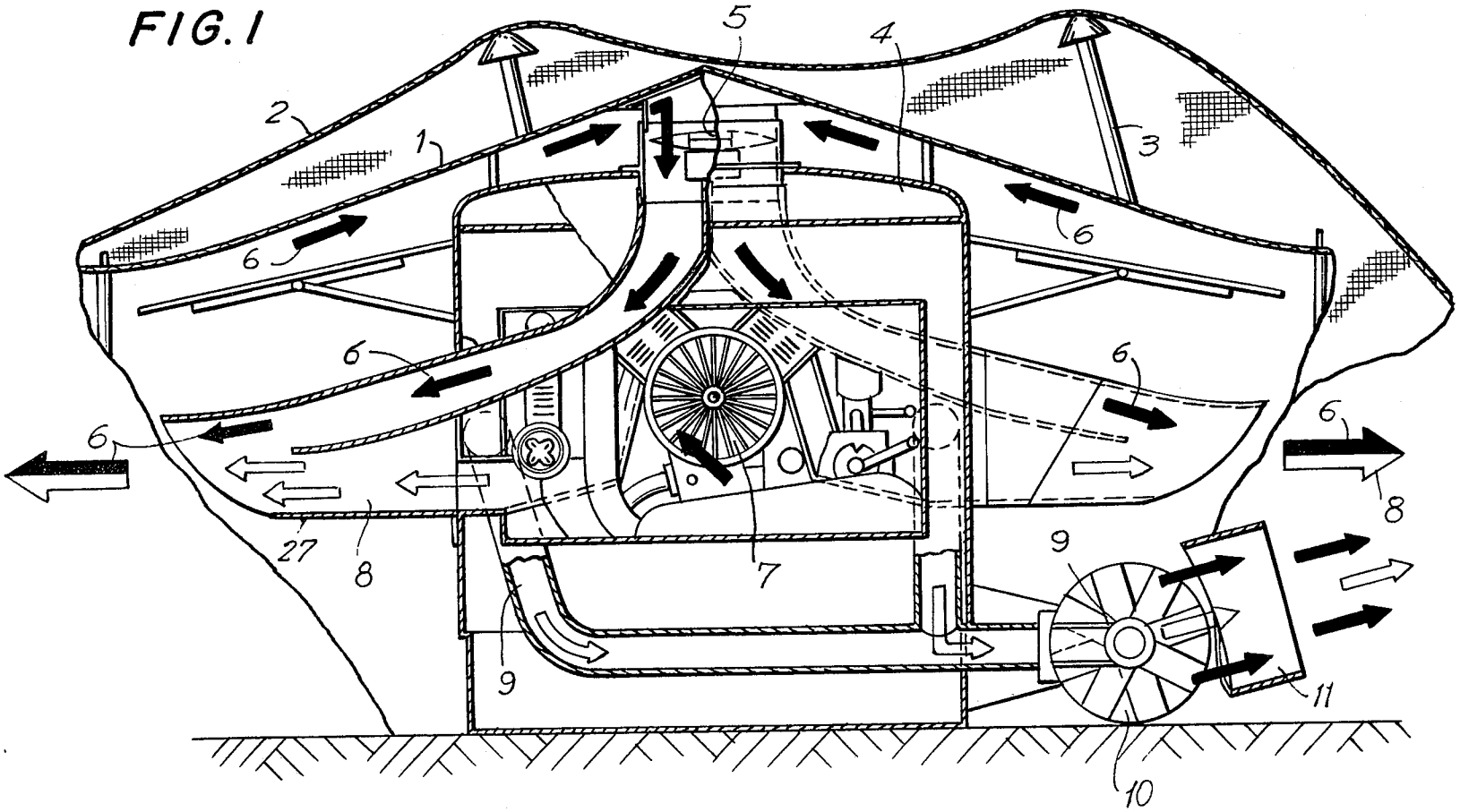
FIG. 1 shows a schematic of a camouflaging set up for a Diesel engine.

FIG. 1 shows a schematic of the set-up for camouflaging a Diesel engine generator which is based on the above described measures.

A heat-reduction carpet 1 is laid over the Diesel engine 4 at a distance of a few inches where care is taken that air circulation is possible between the generator and the heat-reduction carpet. Above this carpet a broad-band camouflaging net 2 is laid at a distance of at least another few inches supported by a pole 3. The shadow of the camouflaging net upon the carpet prevents the latter from heating during sunlight more than the natural surroundings-cooled by wind and evaporation-thus avoiding a considerable temperature contrast. As the garnishing of the camouflaging net 2 is cut in the well-known manner, the natural air convection and wind make sure that its temperature is largely adapted to the enviornment.

According to another embodiment of the present invention, the garnishing material, set-up as a texture, contains metalized layers 15 or metal layers 19 reflecting incident radar waves. By the above mentioned special cut, a diffuse reflection of radar waves is more or less guaranteed.

Figure 2:
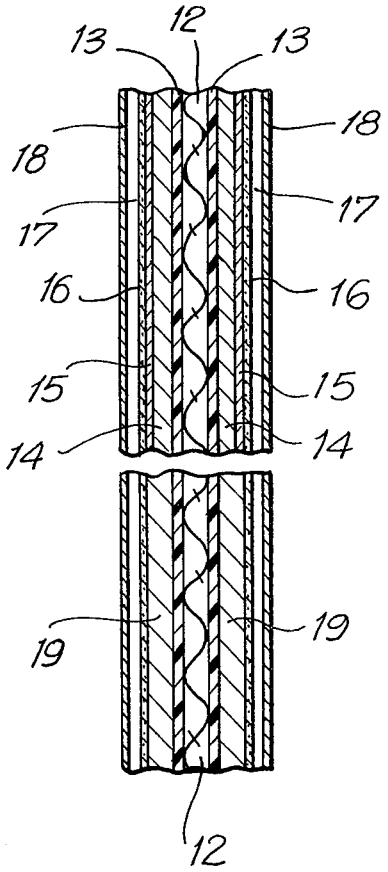
FIG. 2 shows the composition of garnishing material of compound texture.

For reasons of logistics and economics it is proposed to use the same texture as a basic material for the manufacture of heat-reduction carpets and as garnishing for the camouflaging nets; this texture is metalized, preferably on both sides, and then provided with the appropriate IR camouflaging paint on one or both sides. FIG. 2 shows the composition of such a material representing a compound texture. A substance of fabric 12 consisting preferably of polyamide and a coating 13 consisting preferably of soft PVC serve as the basic fabric.

Another embodiment of the invention is, that the fabric is provided with a metallic paint 19 based on a IR-transparent binder to maintain the reflection of the metallic pigments of the paint.

On the other hand, it is proposed to apply the metalization 19 chemically, e.g., precipitate metal out of a metal-salt solution or dispersion upon fabric 12, 13.

Another possibility of applying a metallic layer 19 is to subject the fabric 12, 13 to a glow-discharge in order to remove the residues from the surface, and then to metalize it by vacuum vapor deposition.

Another possibility of metalization is to line the fabric 12, 13 preferably on both sides with a thin metal foil 19, preferably of aluminum.

In order to obtain good bending strength and cease-proofness it is alternatively proposed to line fabric 12, 13 preferably on both sides with metalized plastic foil 14, preferably made by vacuum vapor deposition.

The thickness of the metalization should be of some 100 nm (nanometer $=10^{-9}$ meter). The very thin paint layer 16 serves as a protection for the aluminum deposit and as a primer, improving the adherence of the subsequent paint layers.

Figure 3:
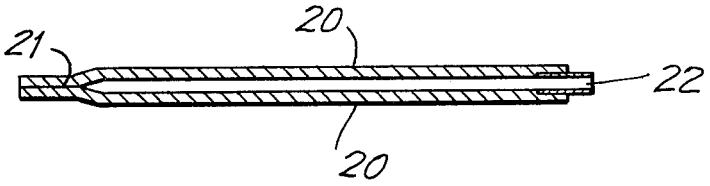
FIG. 3 shows a combination of such garnishing material textures.
Figure 4:
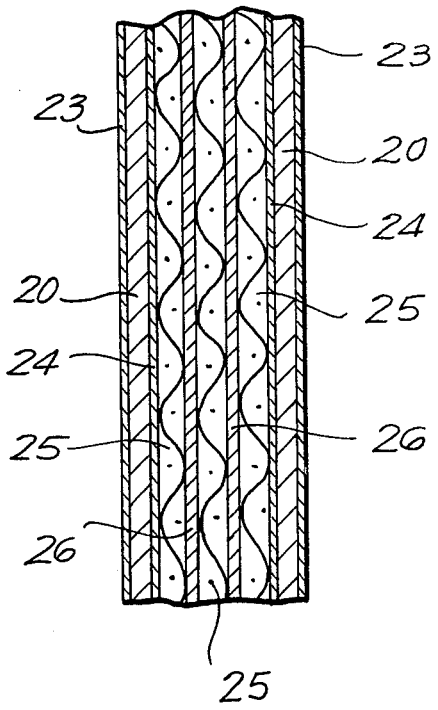
FIG. 4 shows an embodiment of heat-reduction carpet.

According to the present invention, the heat-reduction carpets required for camouflaging the temperature contrast of warm or very hot objects, are a combination according to FIG. 3. This combination consists of two textures 20 sealed at the edge 21 and inflated at opening 22. Inside this set-up, the textures are provided only with a protection paint, thus having the effect of a mirror, avoiding heat transfer by radiation. The intermediate air layer also reduces the heat conduction. FIG. 4 shows another embodiment of the heat-reduction carpet. The textures 20 are painted on the outside 23 while the inside 24 is highly reflecting. In the inside, there are nets 25, providing a small gap and therefore air isolation, and mirror foils 26 metalized on both sides. By means of nets 26 and textures 20, foils 26 are protected against mechanical damage and have a thickness of only a few microns.

Such textures have the decisive advantage of a very high heat-reduction while consuming only a small weight and volume with respect to radiation as well as convection and conduction, thus reducing a temperature contrast of more than 100° K. between target and background to fractions of 1° K.

It has been found that heat-reduction carpets should be applied only at areas of the military objects of a relatively high temperature contrast, i.e., a temperature level of the surface of more than 10° K. above that of the natural background.

Accordingly heat-reduction carpets should be tailored to the geometrical form of the hot areas of the military object, e.g., the hood of vehicles or the front of a tank, etc.

It is further proposed to provide the heat-reduction carpet on the side facing the object with a completely IR-transparent paint and not with a normal IR camouflaging paint in order to reduce heat radiation from the start, because then the reflection of the metalization is completely maintained.

Nets for camouflaging military targets in the spectral range from visible light to radar waves using said specially cut garnishing containing metallic layers are according to the invention very effective against radar reconnaissance if the surface resistivity is in the order of some 10 ohms/square. If, in addition, the emission factor of the paints is varied in the 3 to 5 $\mu$m region between 50 and 90%, and in the 8 to 14 $\mu$m region between 60 and 95% when the observer scans the surface, such a net will blend perfectly into the background under all atmospheric and reconnaissance conditions.

The top layer of the camouflaging net 17 is a thin layer of ultraviolet reflecting paint 18 that is transparent to all other spectral regions and serves for structurization of the emission factor also in this region.

It is proposed to achieve this by choosing a layer of an optical thickness of $\lambda/4$ ($\lambda/4$ wavelengths) for UV. Such a layer is transparent in the visible range and has no effect at all in the IR region. Moreover, ultraviolet light absorbing particles can be added to improve the adaption to the natural background.

In the case that a military object constantly produces heat, it is not sufficient to reduce the temperature contrast by heat damming only, because in this case any amount of heat could accumulate beneath the heat-reduction carpet. Therefore the heat must be removed from the camouflaging set-up in a way invisible to IR observation. For a heat carrier invisible to thermal imaging, only gases can be removed that are also present in the atmosphere since their self-radiation is reabsorbed in the air. If, for example, a combustion engine according to FIG. 1 is cooled by a turboblower 7 and the warmed-up cooling air 8 is blown off the camouflaging set-up via channel 27, it is invisible through the atmosphere because oxygen, nitrogen, water vapor and carbon dioxyde, the main components of the exhaust gases, radiate in spectral regions off the atmospheric windows. This results because there the atmosphere is self-evidently highly absorbing, i.e. the warmed-up air is highly self-radiating. Care should be taken, however, that this warmed-up air does not hit solid objects such as conducting channels, heat-reduction carpets, camouflaging nets or nearby standing trees, since these objects would emit black body heat radiation which is transmitted through the atmospheric windows.

According to the present invention this is achieved by covering the warmed-up air 8 by a stream of cold air 6 which ensures that the outside parts of the conducting channels remain cool: the warmed-up air is blown off the camouflaging set-up by means of blower 7, is covered by laminarly streaming cold air, and driven by means of blower 5.

According to another embodiment of the invention, the cold air 6 used for covering the hot exhaust gases is sucked into the camouflaging set-up beneath the heat-reduction carpet 1 so that accumulation of warmed-up air is avoided here. This reduces essentially the heat transfer by convection and thus the outside temperature of the generator housing 4 as well as the inside temperature of the carpet 1.

Camouflaging of the exhaust pipe is effected as already disclosed in the German patent application No. P 27 31 205, by a laminar flow 10 of cooling air surrounding the hot exhaust gases 9, mainly consisting of $CO_2$ and $H_2O$, i.e. of gases present in the atmosphere. Their narrow-band characteristic radiation is reabsorbed resonantly in the atmosphere. Since, however, these gases in many cases warm up solid objects, such as bushes, trees etc., which then appear brightly radiating in the thermal image, it is proposed that the tail of the channel 11 carrying the two air streams be directed to the open air.

Without further analysis, the foregoing will freely reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

We claim:

1. Camouflaging net for military targets effective in the spectral range from visible light to radar waves comprising in sequence (a) a fabric texture base;

(b) a soft plastic coating on said base;

(c) a metallic layer adhering to said coating; and (d) a paint layer thereon which layers (c) and (d) have in combination an emission factor in the 3 to 5 μm spectral region of between 50 to 90% and in the 8 to 14 μm spectral region of between 60 and 95%.

2. Camouflaging net as in claim 1, wherein there is also provided a thin paint layer between said layers (c) and (d) to protect the metal layer and as a primer for subsequent paint layers.

3. Camouflage net as in cliam 2, wherein the fabric texture base (a) is made of a polyamide.

4. Camouflage net as in claim 3, wherein the soft plastic coating (b) is polyvinyl chloride.

5. Camouflage net as in claim 4, wherein the metal layer is aluminum.

6. Camouflage net as in claim 5, wherein the aluminum layer is vapor deposited.

7. Camouflage net as in claim 6, wherein the paint has pigments therein that correspond from the visible and near infrared region to chlorphyl.

8. Camouflaging net as in claim 1, wherein there is also added a thin layer of ultraviolet reflecting paint that is transparent to all other spectral regions.

9. Camouflage arrangement for exhaust gas-type heat emitting military targets comprising the combination of a camouflaging net produced of (a) a fabric texture base;

(b) a soft plastic coating on said base;

(c) a metallic layer adhering to said coating; and (d) a paint layer thereon which layers (c) and (d) have in combination an emission factor in the 3 to 5 μm spectral region of between 50 to 90% and in the 8 to 14 μm spectral region of between 60 and 95% for reducing emission and/or remission contrast of a target towards a natural background; each layer of said net affecting part of said total electromagnetic spectrum; said layers being arranged such that camouflaging of a single layer does not destroy remaining layers;

with heat-reduction carpets for reducing temperature contrast between target and backgrond of targets with elevated temperatures; and means for further reducing temperature contrast of heat-producing objects by blowing off hot gases by laminar flows of cold air in channels to prevent the warming of the camouflaging net by said hot gases.

10. Camouflage arrangement as in claim 9, wherein said camouflage net comprises a combination of a plurality of layers sealed at an edge and being inflatable.

11. Camouflage arrangement as in claim 9, wherein said camouflage net comprises a plurality of sealed layers having an intermediate space with the two outside layers having camouflaging paint, inside layers of said carpet having thin plastic foils metallized on both sides; and light fabric nets in said intermediate space of said layers having a mesh width of a plurality of millimeters.

12. Camouflage arrangement as in claim 9, wherein said net on the side which is facing the heat emitting target is covered with an IR-transparent paint for the wavelength region of $\lambda=2$–$14$ μm.

13. A method for camouflaging military targets in the spectral range of electromagnetic radiation from ultraviolet light to radar waves by contrast reduction between target and background, comprising the steps of:

(i) reducing emission and/or remission contrast of a target towards a natural background by applying camouflaging nets comprising applying in sequence:

(a) a fabric texture base;

(b) a soft plastic coating on said base;

(c) a metallic layer adhering to said coating; and (d) a paint layer thereon which layers (c) and (d) have in combination an emission factor in the 3 to 5 μm spectral region of between 50 to 90% and in the 8 to 14 μm spectral region of between 60 and 95% each layer of said texture affecting part of said total electromagnetic spectrum; arranging said layers such that camouflaging effect of a single layer does not destroy the remaining layers;

(ii) reducing the temperature contrast between target and background of targets with elevated temperatures by heat-reduction carpets;

(iii) reducing further temperature contrast of heat-producing objects by blowing off hot gases by laminar flows of cold air in channels for preventing warming of camouflaging nets by said hot gases.

14. A method as defined in claim 13, comprising covering hot areas of military targets by heat-reduction carpets, at a distance of a few inches so as to allow air circulation beneath said carpets, with camouflaging nets being applied above said carpets during sunlight so as to prevent additional heating by sunlight.

15. A method as in claim 13 comprising employing camouflage nets having metal-like reflecting properties with a surface resistivity of some 10 ohms/square.

16. A method as defined in claim 13, comprising sucking in cold air for surrounding hot gases so as to cool the bottom side of said carpets.

17. A method as defined in claim 13, comprising carrying the hot air stream, surrounded by cold air, through a turnable and tiltable channel therefor.

* * * * *

UNITED STATES PATENT AND TRADEMARK OFFICE

CERTIFICATE OF CORRECTION

PATENT NO. : 4,473,826

DATED : September 25, 1984

INVENTOR(S) : GUNTER PUSCH et al

It is certified that error appears in the above-identified patent and that said Letters Patent are hereby corrected as shown below:

In col. 1, line 38, insert--German-- before "disclosure";
line 47, insert --German-- before "patent" and change "p" to --P--.
In col. 3, line 11, change "enviornment" to --environment--;
line 28, delete the comma;
line 54, delete the comma.
In col. 4, line 57, change "dioxyde" to --dioxide--.

In col. 5, line 58, change "chlorphyl" to --chlorophyll--.
In col. 6, line 11, change "backgrond" to --background--;
line 46, insert --effect of the-- before "remaining".

Signed and Sealed this

*Twenty-sixth* Day of *November 1985*

[SEAL]

*Attest:*

DONALD J. QUIGG

*Attesting Officer*

*Commissioner of Patents and Trademarks*